US009624657B2

(12) United States Patent
Matsunaka et al.

(10) Patent No.: US 9,624,657 B2
(45) Date of Patent: Apr. 18, 2017

(54) URINAL

(71) Applicant: TOTO LTD., Kitakyushu-shi, Fukuoka (JP)

(72) Inventors: Satoshi Matsunaka, Kitakyushu (JP); Yuichi Furuta, Kitakyushu (JP); Hironori Yamasaki, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 84 days.

(21) Appl. No.: 14/839,311

(22) Filed: Aug. 28, 2015

(65) Prior Publication Data

US 2016/0083948 A1 Mar. 24, 2016

(30) Foreign Application Priority Data

Sep. 18, 2014 (JP) ..... 2014-189753

(51) Int. Cl.
*E03D 13/00* (2006.01)
*E03D 5/10* (2006.01)

(52) U.S. Cl.
CPC ..... *E03D 13/007* (2013.01); *E03D 5/10* (2013.01)

(58) Field of Classification Search
CPC ..... E03D 13/007; E03D 5/10
USPC ..... 4/301, 303, 309
See application file for complete search history.

(56) References Cited

U.S. PATENT DOCUMENTS

2014/0352048 A1* 12/2014 Nakamura ..... E03D 13/007 4/309

* cited by examiner

*Primary Examiner* — Tuan N Nguyen
(74) *Attorney, Agent, or Firm* — Brooks Kushman P.C.

(57) ABSTRACT

A urinal capable of constraining the occurrence of uric scale in a discharge horizontal branch pipe even if flush water volume has been reduced by water conservation is disclosed. A urinal includes a control unit with a main flush mode M0; a first equipment flushing mode M1 in which a portion of flush water flushes the upstream side of a connecting portion; and a second equipment flushing mode M2 in which a portion of flush water flushes the upstream side of the connecting portion. At least one of either the first mode M1 or the second mode M2, the value of the discharge volume or the discharge instantaneous flow volume discharged is set to be equal to or greater than the value of the discharge volume or the discharge instantaneous flow volume in the main flush mode.

9 Claims, 9 Drawing Sheets

URINAL

CROSS-REFERENCE TO RELATED APPLICATIONS

This application claims priority to JP application JP 2014-189753 filed on Sep. 18, 2014, the disclosure of which is incorporated in its entirety by reference herein.

TECHNICAL FIELD

The present invention pertains to a urinal, and more particularly to a urinal connected to a discharge horizontal branch pipe by a urinal discharge pipe.

BACKGROUND

For some time, as shown in Patent Document 1 (Japanese Published Unexamined Patent Application 2013-15523), urinals have been known in which, in order to constrain the occurrence of uric scale, an equipment protection flush operation was performed when the number of uses or a usage time interval had respectively reached predetermined measurement values. In this urinal equipment protection flush operation, flush water is spouted not only from the toilet spout portion but also from a hand sink spout portion to raise the instantaneous flow volume during the equipment protection flush operation to be greater than the instantaneous flow volume when the urinal main unit is flushed, thereby raising the water level inside the horizontal plumbing to flush the water line, which is the border portion between urine-mixed flush water and air.

Also, as shown in Patent Document 2 (Japanese Published Unexamined Patent Application 2014-062459), there is a known problem in that due to reverse flow of flush water mixed with urine to the upstream side of horizontal plumbing installed downstream of the urinal for discharge, urine remains upstream after completion of discharge and uric scale forms; to solve this problem a urinal is known in which a first flushing mode for substituting flush water for urine which remains, pooled in a trap, and a second flushing mode for flushing residual urine left in the horizontal plumbing by the first flushing mode, are executed.

SUMMARY

Technical Problem

In recent years, with increased environmental awareness the demand for water conserving has been growing further, and leading to the need to reduce the volume of flush water to flush the bowl portion of a urinal.

However when attempts are made to reduce flush water volume, the reduction in the volume of flush water flushing the discharge plumbing raises the risk that flushing out of discharge plumbing will be insufficient, leading to the problem that uric scale can more easily form.

If reducing the flush water volume in a urinal, it is also necessary to reduce the volume of seal water (pooled water) in the discharge trap portion corresponding to urinal flush water volume, therefore the concentration of urine remaining in the discharge trap after a user has urinated is greater than in the past, and the concentration of urine discharged in a urinal main flush (full flush) into the horizontal plumbing also increases, leading to the problem that when this high concentration urine remains in the horizontal plumbing, uric scale can even more easily form.

I.e., as shown in Patent Document 1, if the only measure taken is to increase the instantaneous flow volume flushed during equipment protection flushing, then the problem occurs that urine-mixed flush water with a high urine concentration remains, having reverse-flowed to the upstream side inside the horizontal plumbing, and uric scale is produced.

In a second flushing mode for flushing residual urine remaining in horizontal plumbing as shown in Patent Document 2, when flush water volume is reduced the problem occurs that flush water on the upstream side of the horizontal plumbing is still insufficient, and in the second flushing mode the problem is that flushing the water line, being the border part between urine-mixed flush water and air, is not assumed, so sufficient cleaning can also not be achieved at the water line inside the horizontal plumbing.

Therefore even if the flush water volume has been reduced due to water conservation, inside the horizontal plumbing it is necessary to constrain the occurrence of uric scale caused by reverse flow of urine to the upstream side, and to constrain the occurrence of uric scale close to the water line.

The present invention was undertaken to solve deficiencies in the conventional art, and is able to discharge from discharge horizontal plumbing urine on the inside of the discharge horizontal branch pipe which has reverse-flowed to upstream of the connecting portion to which the urinal discharge pipe is connected and remains after the main flush mode has been executed; it is able to constrain the occurrence of uric scale in the discharge horizontal branch pipe on the upstream side of the connecting portion to which the urinal discharge pipe is connected; it is able to flush the vicinity of the flush water line inside the discharge horizontal branch pipe with relatively low urine concentration flush water; and it is able to constrain the occurrence of uric scale by effectively flushing in the vicinity of the water line, where uric scale easily adheres. The invention therefore has the object of providing a urinal capable of constraining the occurrence of uric scale in a discharge horizontal branch pipe even if flush water volume has been reduced by water conservation.

Solution to Problem

To achieve the above object, the present invention is a urinal connected to a horizontal branch pipe by a urinal discharge pipe, comprising: a bowl portion for receiving a user's urine; a discharge trap portion for discharging to the downstream side flush water or urine flowing in from a discharge opening formed on the bottom portion of this bowl portion; a water supply means for supplying flush water to the bowl portion; and a control means for controlling the supply of flush water to the bowl portion; wherein the control means has: a main flush mode for flushing the bowl portion which has received the user's urine and discharging urine in the discharge trap; a first equipment flushing mode in which, after a main flush mode is executed, a part of the flush water flushes out the discharge horizontal branch pipe upstream of the connecting portion where the urinal discharge pipe is connected; and a second equipment flush mode in which, after the first equipment flushing mode has been executed, and after a predetermined time has elapsed during which it is assumed that flush water which has flushed the side upstream of the connecting portion in the first equipment flushing mode will have flowed to downstream of the connecting portion, a part of the flush water flushes the upstream side of the connecting portion; wherein in at least one of either the first equipment flushing mode or the second equipment flush mode, the value of the discharge water volume or of the discharge instantaneous flow volume discharged to the downstream side from the discharge trap portion shall be a value equal to or greater than the value of the discharge water volume or of the discharge instantaneous flow volume discharged to the downstream side from the discharge trap portion in the main flush mode.

In the invention thus constituted, even if urine in the discharge horizontal branch pipe reverse-flows to the upstream side of the connecting portion to which the urinal discharge pipe is connected in the main flush mode in which urine in the discharge trap portion is discharged, two flushings are possible, being the first equipment flushing mode in which, after a main flush mode is executed, a part of the flush water flushes out the discharge horizontal branch pipe upstream of the connecting portion where the urinal discharge pipe is connected, and the second equipment flush mode in which, after the first equipment flushing mode has been executed, and after a predetermined time has elapsed during which it is assumed that flush water which has flushed the side upstream of the connecting portion in the first equipment flushing mode will have flowed to downstream of the connecting portion, a part of the flush water flushes the upstream side of the connecting portion. It is also acceptable to repeatedly cycle this first equipment flushing mode and second equipment flushing mode. In either one of the first equipment flushing mode and the second equipment flushing mode, the value of the discharge water volume or instantaneous flow volume discharged to the downstream side from the discharge trap portion is a value equal to or greater than the value of the discharge water volume or instantaneous flow volume discharged from the discharge trap portion in the main flush mode.

Therefore urine on the inside of the discharge horizontal branch pipe which has reverse-flowed to upstream of the connecting portion to which the urinal discharge pipe is connected and remains after the main flush mode has been executed can be discharged from the discharge horizontal branch pipe, and the occurrence of uric scale in the discharge horizontal branch pipe on the upstream side of the connecting portion to which the urinal discharge pipe is connected can be constrained.

Also, in either one of the first equipment flushing mode and the second equipment flushing mode, the value of the discharge water volume or instantaneous flow volume discharged to the downstream side from the discharge trap portion will be a value equal to or greater than the value of the discharge water volume or instantaneous flow volume discharged from the discharge trap portion in the main flush mode. Therefore the height of the flush water line inside the discharge horizontal branch pipe in at least one of either the first equipment flushing mode or the second equipment flushing mode can be made higher than the height of the flush water line inside the discharge horizontal branch pipe in the main flush mode. The vicinity of the flush water line inside the discharge horizontal branch pipe can be flushed with relatively low urine concentration flush water in the main flush mode, effectively flushing the vicinity of the flush water line where uric scale is prone to adhere, thereby constraining the occurrence of uric scale.

Therefore even if flush water volume has been reduced by water conservation, the occurrence of uric scale in a discharge horizontal branch pipe can be constrained.

In the present invention the value of the discharge water volume or discharge instantaneous flow volume in the first equipment flushing mode is preferably equal to or greater than the value of the discharge water volume or discharge instantaneous flow volume in the main flush mode; moreover, the value of the discharge water volume or discharge instantaneous flow volume in the second equipment flushing mode is equal to or greater than the value of the discharge water volume or discharge instantaneous flow volume in the first equipment flushing mode.

In the invention thus constituted, the value of the discharge water volume or discharge instantaneous flow volume discharged from the discharge trap portion in the first equipment flushing mode and second equipment flushing mode is equal to or greater than the value of the discharge water volume or discharge instantaneous flow volume discharged from the discharge trap portion in the main flush mode.

The height of the flush water line inside the discharge horizontal branch pipe in the first equipment flushing mode may be made equal to or greater than the height of the flush water line inside the discharge horizontal branch pipe in the main flush mode; in addition, the height of the flush water line inside the discharge horizontal branch pipe in the second equipment flushing mode may be made equal to or greater than the height of the flush water line inside the discharge horizontal branch pipe in the first equipment flushing mode. Therefore the vicinity of the flush water line inside the discharge horizontal branch pipe in the main flush mode can be flushed with flush water in the first equipment flushing mode, which has a relatively lower urine concentration than flush water in the main flush mode and, in addition, flushing can be performed with flush water in the second equipment flushing mode, which has a relatively lower urine concentration than flush water in the first equipment flushing mode, so the occurrence of uric scale can be constrained by effectively flushing in the vicinity of the water line, where uric scale easily adheres.

Also, urine in the horizontal branch pipe which has reverse-flowed to the upstream side of the connecting portion to which the urinal discharge pipe is connected and remains after execution of the main flush mode can be flushed with first equipment flushing mode flush water, which reaches further upstream than that urine; it can further be flushed with second equipment flushing mode flush water, which reaches further upstream than the first equipment flushing mode flush water, effectively discharging the urine from the discharge horizontal branch pipe, so the occurrence of uric scale in the discharge horizontal branch pipe on the upstream side of the connecting portion to which the urinal discharge pipe is connected can be constrained.

Therefore even if flush water volume has been reduced by water conservation, the occurrence of uric scale in a discharge horizontal branch pipe can be constrained.

In the present invention the value of the discharge instantaneous flow volume in the first equipment flushing mode is preferably equal to or greater than the value of the discharge instantaneous flow volume in the main flush mode; in addition, the value of the discharge instantaneous flow volume in the second equipment flushing mode is preferably equal to or greater than the value of the discharge instantaneous flow volume in the second equipment flushing mode.

In the invention thus constituted, the value of the instantaneous flow volume discharged downstream from the discharge trap portion is gradually increased. Therefore the height of the flush water line inside the discharge horizontal branch pipe in the first equipment flushing mode may be made equal to or greater than the height of the flush water line inside the discharge horizontal branch pipe in the main flush mode; in addition, the height of the flush water line inside the discharge horizontal branch pipe in the second equipment flushing mode may be made equal to or greater than the height of the flush water line inside the discharge horizontal branch pipe in the first equipment flushing mode. Hence the vicinity of the flush water line inside the discharge horizontal branch pipe in the main flush mode can be flushed with flush water in the first equipment flushing mode, which has a relatively lower urine concentration than flush water in the main flush mode and, in addition, flushing can be performed with flush water in the second equipment flushing mode, which has a relatively lower urine concentration than flush water in the first equipment flushing mode, so the occurrence of uric scale can be constrained by effectively flushing in the vicinity of the water line, where uric scale easily adheres.

Also, urine which has reverse-flowed in the horizontal branch pipe and remains after execution of the main flush mode can be flushed with first equipment flushing mode flush water, which reaches further upstream than that urine; it can further be flushed with second equipment flushing mode flush water, which reaches further upstream than the first equipment flushing mode flush water, effectively discharging the urine from the discharge horizontal branch pipe, so the occurrence of uric scale in the discharge horizontal branch pipe on the upstream side of the connecting portion to which the urinal discharge pipe is connected can be constrained.

Therefore even if flush water volume has been reduced by water conservation, the occurrence of uric scale in a discharge horizontal branch pipe can be constrained.

In the present invention, in any of the main flush mode, first equipment flushing mode, and second equipment flushing mode, the supply instantaneous flow volume to the bowl portion is preferably essentially the same, and in each of the main flush mode, first equipment flushing mode, and second equipment flushing mode, the discharge instantaneous flow volume value is determined according to the head height of the flush water temporarily pooled near the entrance to the discharge trap portion.

In the invention thus constituted, when the supply instantaneous flow volume from the water supply means to the bowl portion is made essentially the same in any of the main flush mode, first equipment flushing mode, or second equipment flushing mode, the head height of flush water temporarily pooled near the entrance to the discharge trap portion, which is affected by the flow resistance of the discharge trap portion, can be made different in each of the main flush mode, first equipment flushing mode, and second equipment flushing mode. Therefore the value of the discharge instantaneous flow volume can be determined in a relatively simple way for each of the main flush mode, first equipment flushing mode, and second equipment flushing mode in accordance with the height of the flush water head temporarily pooled near the entrance to the discharge trap portion, without requiring a special configuration to change the instantaneous supply flow volume from the supply means to the bowl portion.

In the present invention, following execution of a main flush mode, at a predetermined time interval the control means repeatedly executes the first equipment flushing mode and, following execution of the first equipment flushing mode, executes the second equipment flushing mode.

In the invention thus constituted, after execution of the main flush mode, the first equipment flushing mode and, following execution of the first equipment flushing mode, the second equipment flush mode, are repeatedly executed at a predetermined time interval. Therefore equipment flushing is continuously executed, and urine on the inside of the discharge horizontal branch pipe which has reverse-flowed to upstream of the connecting portion to which the urinal discharge pipe is connected and remains can be discharged from the discharge horizontal branch pipe, and the occurrence of uric scale in the discharge horizontal branch pipe on the upstream side of the connecting portion to which the urinal discharge pipe is connected can be constrained.

Also, equipment flushing is continuously executed, and the vicinity of the flush water line inside the discharge horizontal branch pipe can be flushed with relatively low urine concentration flush water in the main flush mode, effectively flushing the vicinity of the flush water line where uric scale is prone to adhere, thereby constraining the occurrence of uric scale.

The present invention furthermore preferably has a sensing means for sensing a user using the urinal, wherein when the first equipment flushing mode or the second equipment flush mode is executed, if the sensing means senses a user, the control means stops the first equipment flushing mode or the second equipment flush mode, and if a user is sensed by the sensing means for a predetermined time or greater, the control means judges that the urinal has been used, and cancels the execution of the subsequent first equipment protection flushing mode and second equipment protection flush mode, executing a main flush mode after the sensing means ceases to sense a user.

In the invention thus constituted, in a state wherein the first equipment protection flushing mode or second equipment protection flush mode is being executed after execution of the main flush mode, if sensing of a user by the sensing means reaches or exceeds a predetermined time, a judgment is made that the urinal was used, and the execution of the subsequent first equipment protection flushing mode or the second equipment protection flush mode is canceled, the main flush mode is executed and, after execution of the main flush mode, the first equipment flushing mode and the second equipment flushing mode executed after execution of the first equipment flushing mode are repeatedly executed at a predetermined time interval.

The present invention furthermore preferably has a sensing means for sensing a user using the urinal; if the sensing means senses a user during the first equipment flushing mode or second equipment flushing mode, the control means stops the first equipment flushing mode or the second equipment flushing mode; if sensing of a user by the sensing means has continued for less than a predetermined time, a judgment is made that the urinal is not being used, and thereafter execution of the first equipment protection flushing mode or second equipment protection flush mode is started.

In the invention thus constituted, in a state wherein the first equipment protection flushing mode or second equipment protection flush mode is being executed after execution of the main flush mode, if sensing of a user by the sensing means continues for less than a predetermined time, a judgment is made that the urinal is not being used, and the execution of the subsequent first equipment protection flushing mode or the second equipment protection flush mode is not canceled, but rather execution of the first equipment protection flushing mode or second equipment protection flush mode is restarted from the stopped state, and the first equipment flushing mode and the second equipment flushing mode executed after execution of the first equipment flushing mode can be repeatedly executed at a predetermined time interval.

In the present invention the control means preferably further comprises an electrolytic water flushing mode wherein, after the second flushing mode is executed, flush water into which electrolytic water has been injected is flowed into the discharge trap portion and the discharge horizontal branch pipe.

In the invention thus constituted, in a state wherein the second flushing mode has been executed and it is assumed that the majority of the urine has been removed from inside the discharge trap portion and the discharge horizontal branch pipe, the control means, by executing the electrolytic water flushing mode and flowing electrolytic water to the discharge trap portion and the discharge horizontal branch pipe, can constrain the growth of bacteria inside the discharge trap portion and the discharge horizontal branch pipe, and more fully constrain the occurrence of uric scale.

In the present invention the control means preferably further comprises an electrolytic water flushing mode wherein, when executing the first flushing mode, the second flushing mode, or the first flushing mode and second flushing mode, flush water into which electrolytic water has been injected is flowed into the discharge trap portion and the discharge horizontal branch pipe.

In the invention thus constituted, in a state wherein the first flushing mode, the second flushing mode, or the first flushing mode and second flushing mode are executed and it is assumed that the majority of the urine has been removed from inside the discharge trap portion and the discharge horizontal branch pipe, the control means, by executing the electrolytic water flushing mode and flowing electrolytic water to the discharge trap portion and the discharge horizontal branch pipe, can constrain the growth of bacteria inside the discharge trap portion and the discharge horizontal branch pipe, and more fully constrain the occurrence of uric scale.

Advantageous Effects of Invention

Using the urinal of the present invention, urine on the inside of the discharge horizontal branch pipe which has reverse-flowed to upstream of the connecting portion to which the urinal discharge pipe is connected and remains after the main flush mode has been executed can be discharged from the discharge horizontal branch pipe, and the occurrence of uric scale in the discharge horizontal branch pipe on the upstream side of the connecting portion to which the urinal discharge pipe is connected can be constrained. Also, the vicinity of the flush water line inside the discharge horizontal branch pipe can be flushed with relatively low urine concentration flush water in the main flush mode, effectively flushing the vicinity of the flush water line where uric scale is prone to adhere, thereby constraining the occurrence of uric scale. Therefore even if flush water volume has been reduced by water conservation, the occurrence of uric scale in a discharge horizontal branch pipe can be constrained.

DETAILED DESCRIPTION

Figure 1:
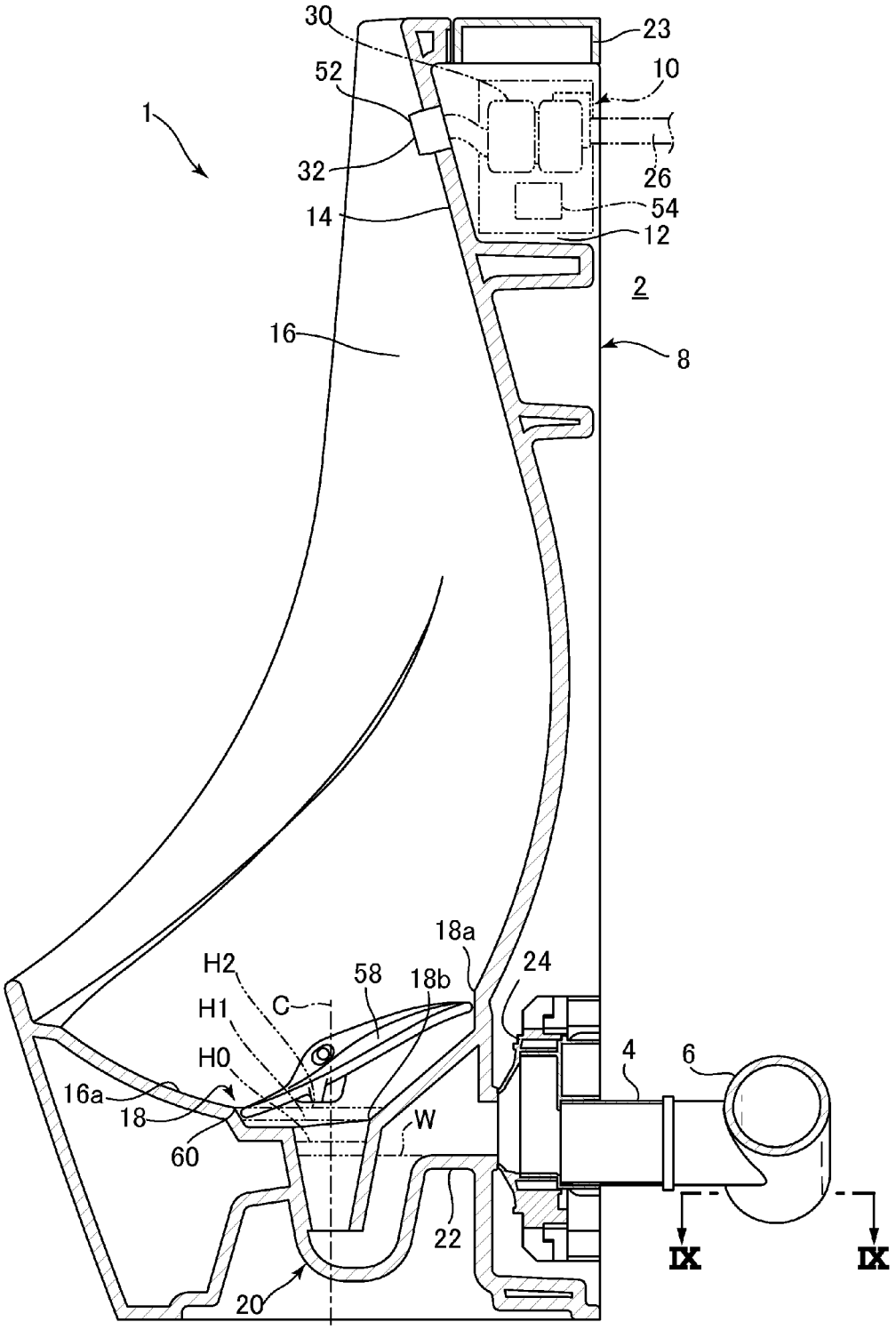
FIG. 1 is a simplified cross section showing a urinal according to an embodiment of the present invention.

Referring to the attached figures, we explain a urinal according to an embodiment of the invention. First, referring to FIGS. 1 and 2, we explain the basic structure of the urinal. FIG. 1 is a simplified cross section showing a urinal according to an embodiment of the present invention, and FIG. 2 is a simplified top view of the interior of the housing chamber at the top portion of a urinal according to an embodiment of the invention.

Reference numeral 1 in FIG. 1 shows a urinal according to an example of an embodiment of the invention, installed either in multiple, lined up on the outer side of a toilet wall surface 2 or alone, in a building. A urinal discharge pipe 4 extending from the toilet wall surface 2 bottom portion of the urinal 1 through the building toilet wall surface 2 to the reverse side of the toilet wall surface 2 is connected at the lower part of the reverse side of the toilet wall surface 2 on which this urinal 1 is installed to a discharge horizontal branch pipe 6 extending horizontally as it tilts slightly downward. The discharge horizontal branch pipe 6 is disposed at a slope greater than horizontal; in the following explanation we will refer to the rising side of the slope as the upstream side, and the falling side of the slope as the downstream side. On the downstream side, this discharge horizontal branch pipe 6 is connected to a vertical discharge pipe (not shown). Each of the urinals 1 discharges the flush water with which it has been flushed (both as pure water only in the supplied state and/or as discharged urine-mixed flush water) to discharge horizontal branch pipe 6 through urinal discharge pipe 4 extending to the back side of the toilet wall surface 2. Note that the present invention is not limited to the affixing portion wall discharge urinal, and may also be applied to a floor discharge urinal, in which the urinal discharge pipe or the discharge horizontal branch pipe are installed on the floor.

Figure 2:
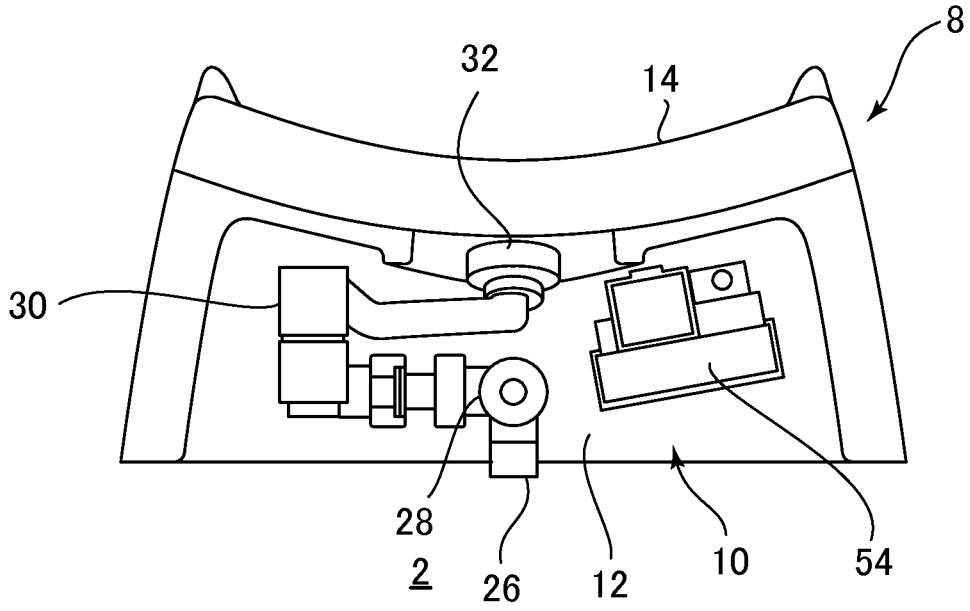
FIG. 2 is a simplified top view of the interior of the housing chamber at the top portion of a urinal according to an embodiment of the invention.

As shown in FIGS. 1 and 2, this urinal 1 comprises a ceramic urinal main body 8 and an automatic toilet flushing unit 10 for flushing this urinal main body 8. Urinal 1 is a wall-hung urinal attached along the toilet wall surface 2 at the back, but may also be a urinal of the floor-mounted type, directly mounted on the floor surface. Urinal 1 may also be of the water conserving type with a flush water volume, for example, of 0.5 L to 2.0 L (preferably 0.8 L to 1.0 L). In the explanation below we will refer to the front elevation side of urinal 1 as the front side, the back elevation side as the rear side (back side), the left side seen from the front elevation of urinal 1 as the left side, and the right side seen from the front elevation of 1 as the right side.

The urinal main body 8 of the urinal 1 comprises: a housing chamber 12 housing an automatic toilet flushing unit 10; a bowl portion 16 forming a bowl surface extending downward from the front surface 14 of this housing chamber 12; a discharge opening portion 18 formed at the bottom portion of this discharge plumbing 16; a discharge trap 20 forming a seal water by accumulating pooled water W at the downstream side of the discharge opening portion 18; and a discharge apparatus connecting portion 22 on the downstream side of this discharge trap 20.

A discharge socket 24 is connected to the discharge apparatus connecting portion 22 on the urinal main body 8; a urinal discharge pipe 4 is connected to the discharge socket 24, and the urinal discharge pipe 4 extends from the front side to the back side of the toilet wall surface 2 to be connected to the discharge horizontal branch pipe 6.

Figure 3:
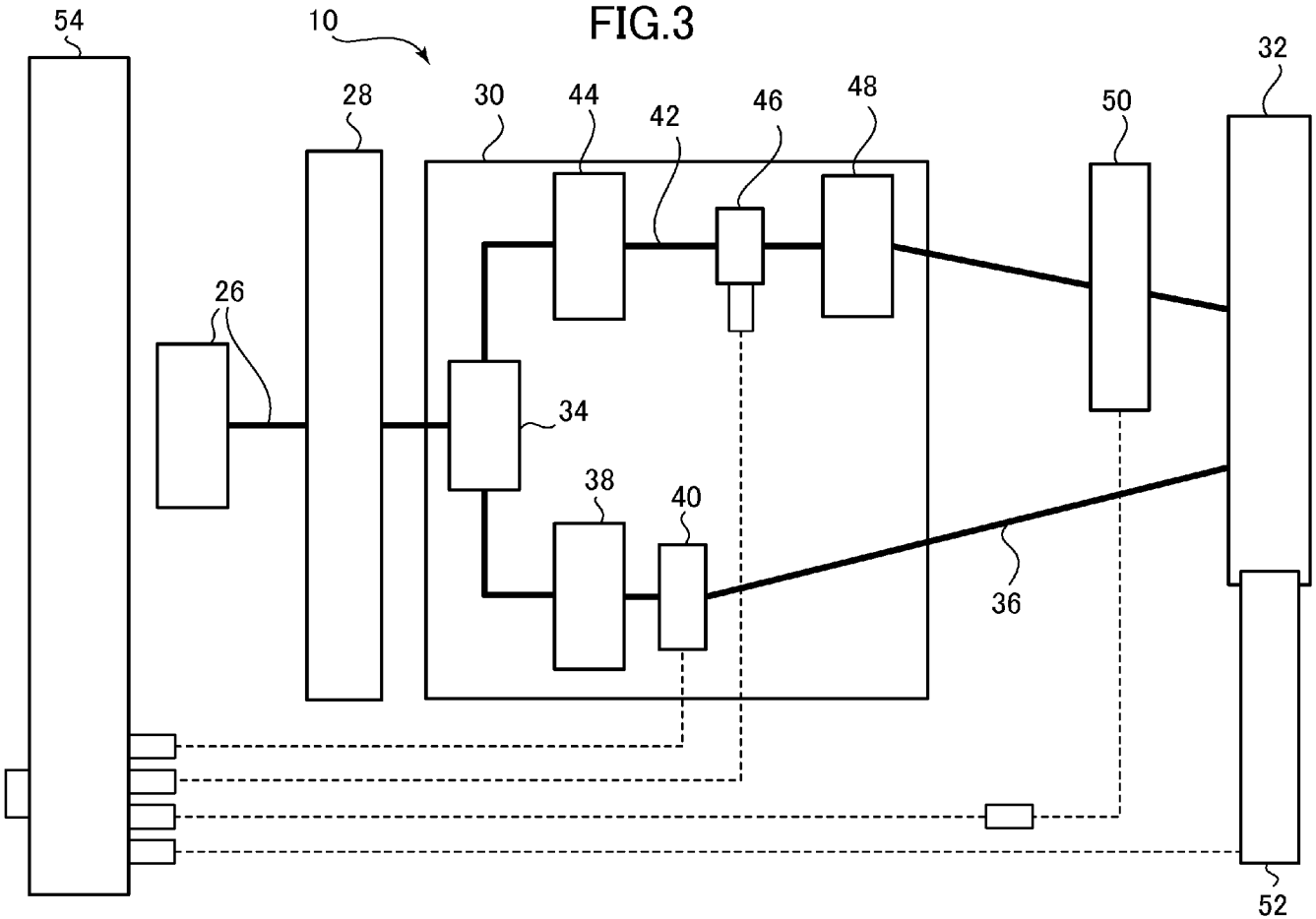
FIG. 3 is a block diagram showing in a simplified manner the internal structure of an automatic toilet flushing unit in a urinal according to an embodiment of the invention.

Next we explain the automatic toilet flushing unit 10 shown in FIGS. 2 and 3.

FIG. 3 is a block diagram showing the simplified structure of an automatic toilet flushing unit in a urinal according to an embodiment of the invention.

The housing chamber 12 is formed by the urinal main body 8 and a cover 23. The front surface 14 of the housing chamber 12 is formed to slope toward the rear. The automatic toilet flushing unit 10 housed in the housing chamber 12 comprises: a supply pipe 26 for supplying flush water from a supply source such as municipal water, etc.; a water shut off valve 28 disposed on the supply pipe 26; a valve unit 30 disposed on the downstream side of the water shut off valve 28; and a spreader (water supply means) 32, being a spout portion for spouting flush water supplied from the valve unit 30 into the bowl portion 16.

The valve unit 30 comprises: a branch portion 34 for splitting the supply pipe 26 between a main supply flow path 36 and an electrolytic water flow path 42; a fixed flow volume valve 38 disposed on the main supply flow path 36; a main supply flow path electromagnetic valve (adjustment means) 40 disposed on the downstream side of the fixed flow volume valve 38, for supplying and stopping the main supply water; a fixed flow volume valve 44 disposed on the electrolytic water flow path 42; an electrolytic water flow path electromagnetic valve (adjustment means) 46 disposed on the downstream side of the fixed flow volume valve 44, for supplying and stopping supply water containing electrolytic water, a reverse shutoff valve 48 disposed on the downstream side of the electrolytic water flow path electromagnetic valve 46, and an electrolytic water injection unit 50 for injecting electrolytic water (sterilizing water). Also, a body sensing sensor (sensing means) 52 for sensing the presence of a user, directed at the front face of the bowl portion 16, is attached to the spreader 32. Here the electrolytic water injection unit 50 has a mechanism for producing hypochlorous acid from chloride ions in the flush water in an electrolytic cell to produce electrolytic water (sterilizing water), and is able to inject this electrolytic water (sterilizing water) into the flush water. The electrolytic water (sterilizing water) is water containing a component for producing hypochlorous acid from chloride ions in the flush water, and is effective at sterilizing uric scale germs and bacteria and suppressing growth thereof.

The automatic toilet flushing unit 10 further comprises a control unit 54 capable of controlling the main supply flow path electromagnetic valve 40, etc. based on sensing signals from the body sensing sensor 52 and on a control program or the like.

Specifically, the control unit 54 implements controls to open and close the main supply flow path electromagnetic valve 40 based on sensing signals from the body sensing sensor 52 and on a control program or the like, causing flush water to be spouted from the spreader 32 to the bowl portion 16. When opening the main supply flow path electromagnetic valve 40, the instantaneous flow volume spouted from the spreader 32 is set to be essentially fixed in each of the main flush mode (full flush mode) M0, first equipment flushing mode M1, and second equipment flushing mode M2 described below. Therefore the supply flow volume of flush water spouted from the spreader 32 is determined by the time during which the main supply flow path electromagnetic valve 40 is open.

Note that as a variant example, the spreader 32 may also have an additional supply flow path mechanism, separate from the main supply flow path 36, so as to enable variation of the instantaneous flow volume of flush water which can be spouted therefrom. In such cases, the value of the flush water spouted from the spreader 32 is the total of the supply flow volume of flush water supplied from other supply flow paths and the instantaneous flow volume in addition to the supply flow volume and spout water instantaneous flow volume from the main supply flow path 36.

The control unit 54 controls the opening and closing of the electrolytic water flow path electromagnetic valve 46 and further activates the electrolytic water injection unit 50 based on sensing signals from the body sensing sensor 52 and on a control program or the like, so that flush water into which electrolytic water has been injected is spouted from the spreader 32 into the bowl portion 16.

Next, the bowl portion 16 forms an arcuate surface with a relatively large curvature radius in the horizontal direction in the top portion, and forms an arcuate surface with a relatively small curvature radius in the horizontal direction in the bottom portion. The spreader 32 is disposed at a height position above the center on the left-right center axis line of this bowl portion 16. In addition, the bottom portion of the bowl portion 16 is formed in a basin shape so as to curve and converge. Therefore in each of the flush modes described below, the flush water spouted from the spreader 32 can temporarily accumulate in the vicinity of a discharge opening 60 on the discharge trap 20 inside the bottom portion of the bowl portion 16, and the flush water head height (the height from the surface of pooled water W in normal conditions) exerts pressure on the flush water discharged from the discharge trap 20, changing the flush water instantaneous flow volume and water volume discharged from the discharge trap 20 to the urinal discharge pipe 4 and the discharge horizontal branch pipe 6.

A grate 58 is disposed on the upstream side of the discharge opening portion 18, at the entrance portion 18*a* thereof. In addition, a discharge opening 60 constituting the entrance opening of the discharge trap 20 is formed on the exit opening portion 18*b* on the downstream side of the discharge opening portion 18.

A discharge apparatus connecting portion 22 is disposed on the downstream side of the discharge trap 20, and a discharge socket 24 is connected to the discharge apparatus connecting portion 22, but the discharge socket 24 may be omitted, and the urinal discharge pipe 4 connected to the discharge apparatus connecting portion 22.

Next, referring to FIGS. 4 through 9, we discuss the operation (effect) according to an embodiment of the invention.

Figure 4:
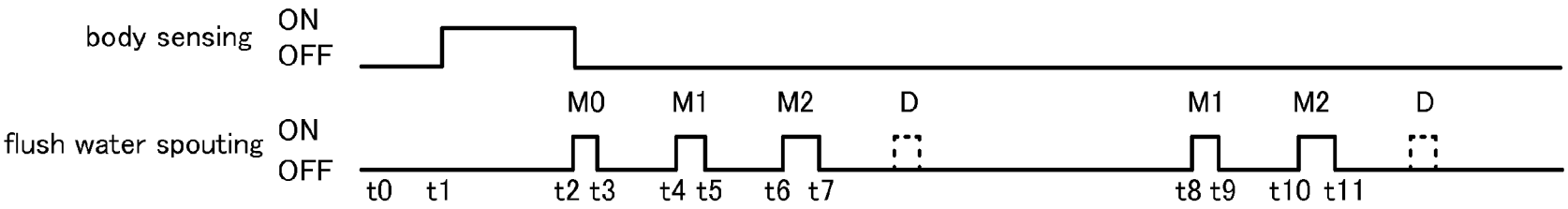
FIG. 4 is a timing chart showing a first example of the flushing action in a urinal according to an embodiment of the invention.
Figure 5:
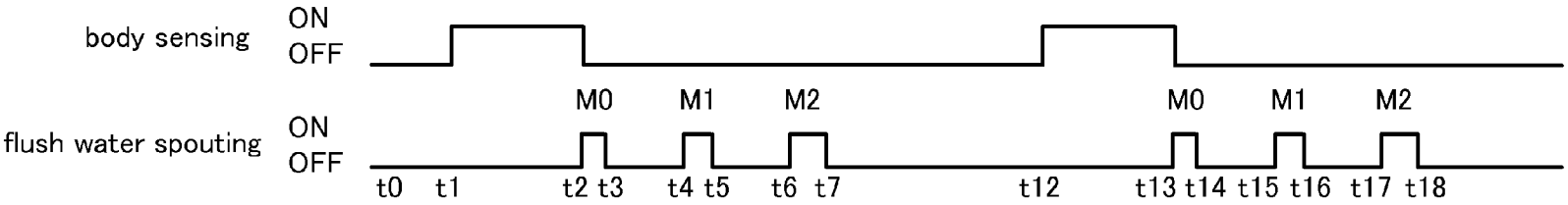
FIG. 5 is a timing chart showing a second example of the flushing action in a urinal according to an embodiment of the invention.
Figure 7A:
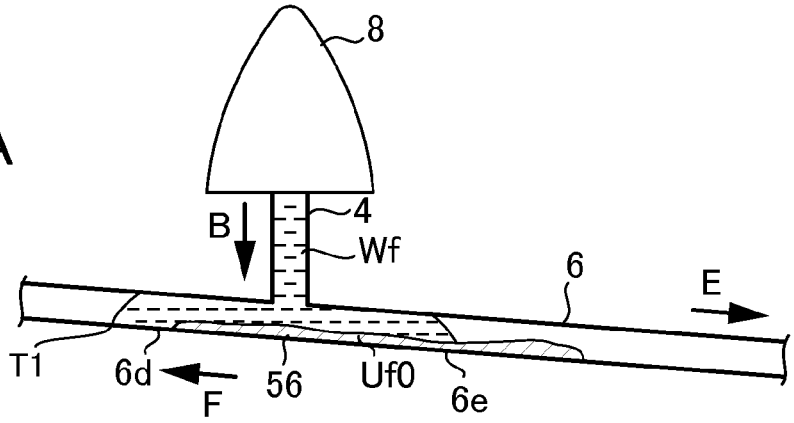
FIG. 7A is a diagram showing a simplified view of the flow of flush water and urine from a urinal into a urinal discharge pipe and discharge horizontal branch pipe, in first equipment flushing mode M1 of a urinal according to an embodiment of the invention.
Figure 7B:
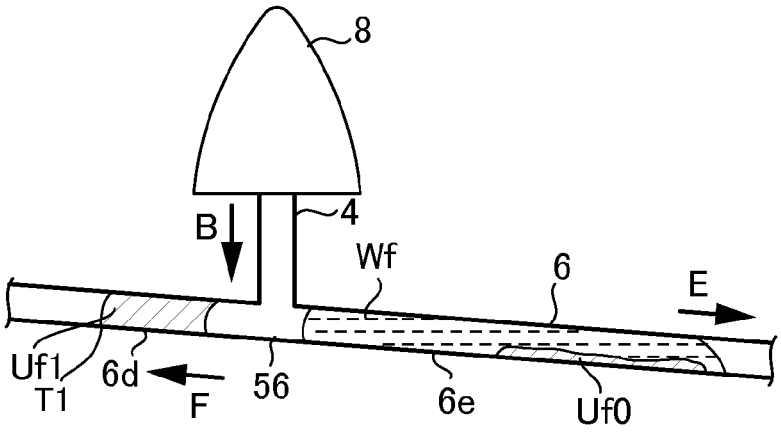
FIG. 7B is a diagram showing a simplified view of the flow of flush water and urine from a urinal into a urinal discharge pipe and discharge horizontal branch pipe, in first equipment flushing mode M1 of a urinal according to an embodiment of the invention.
Figure 7C:
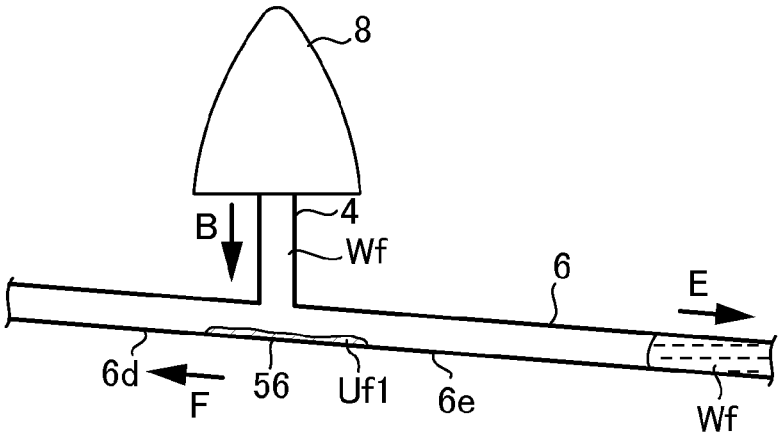
FIG. 7C is a diagram showing a simplified view of the flow of flush water and urine from a urinal into a urinal discharge pipe and discharge horizontal branch pipe, in first equipment flushing mode M1 of a urinal according to an embodiment of the invention.
Figure 8A:
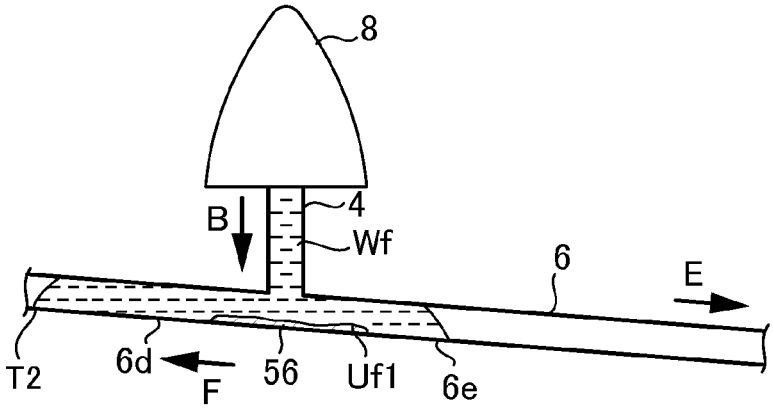
FIG. 8A is a diagram showing a simplified view of the flow of flush water and urine from a urinal into a urinal discharge pipe and discharge horizontal branch pipe, in second equipment flushing mode M2 of a urinal according to an embodiment of the invention.
Figure 8B:
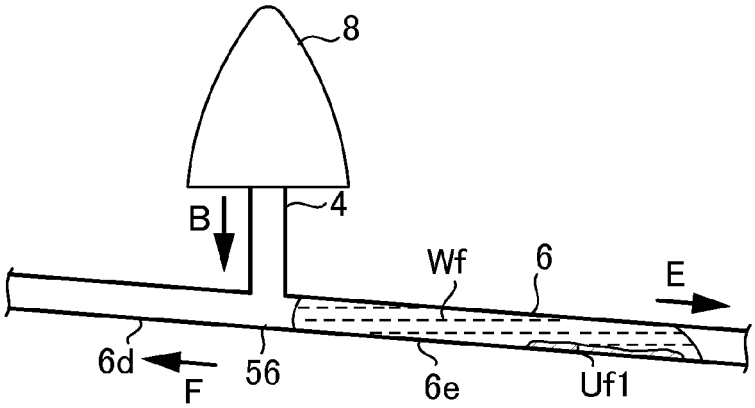
FIG. 8B is a diagram showing a simplified view of the flow of flush water and urine from a urinal into a urinal discharge pipe and discharge horizontal branch pipe, in second equipment flushing mode M2 of a urinal according to an embodiment of the invention.
Figure 8C:
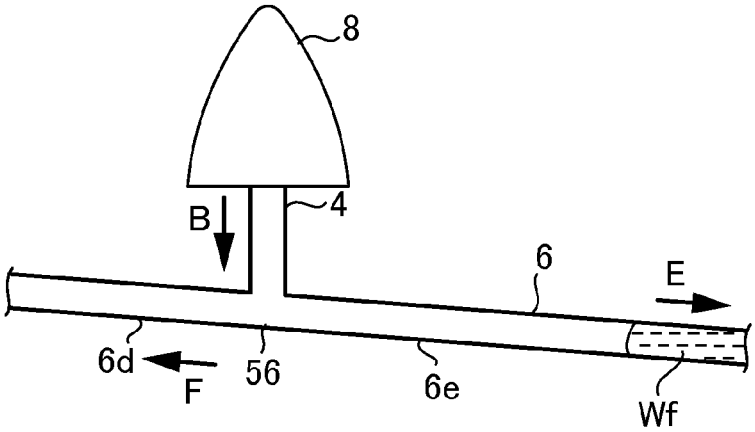
FIG. 8C is a diagram showing a simplified view of the flow of flush water and urine from a urinal into a urinal discharge pipe and discharge horizontal branch pipe, in second equipment flushing mode M2 of a urinal according to an embodiment of the invention.
Figure 9A:
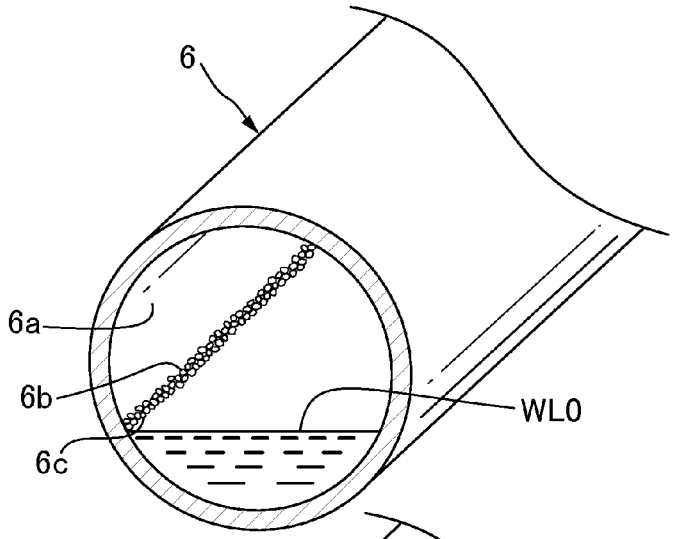
FIG. 9A is a diagram showing the flow of urine and flush water through the discharge horizontal branch pipe when a main flush mode M0 is executed, in a discharge horizontal branch pipe extending to the downstream side of a urinal according to an embodiment of the present invention.
Figure 9B:
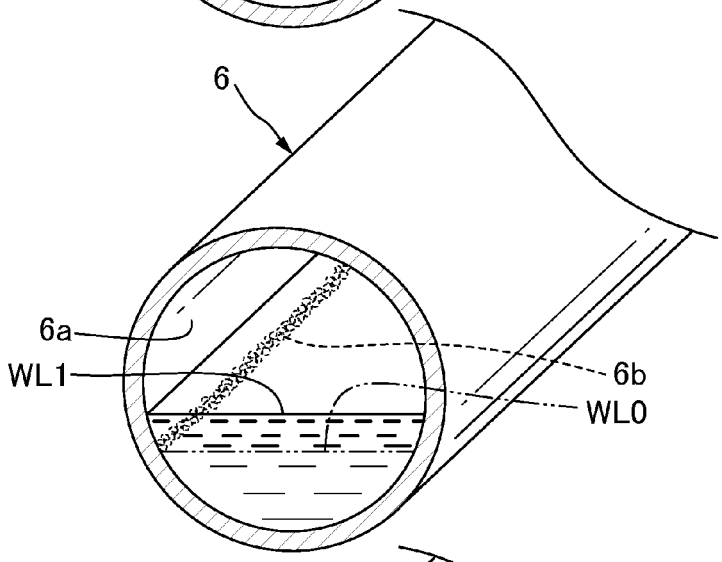
FIG. 9B is a diagram showing the flow of urine-mixed flush water and flush water through the discharge horizontal branch pipe when a first equipment flushing mode M1 is executed, in a discharge horizontal branch pipe extending to the downstream side of a urinal according to an embodiment of the present invention.
Figure 9C:
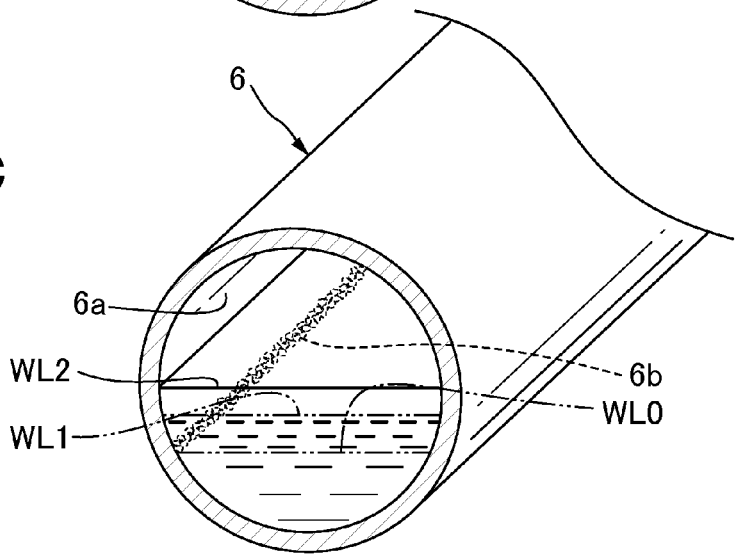
FIG. 9C is a diagram showing the flow of flush water through the discharge horizontal branch pipe when a second equipment flushing mode M2 is executed, in a discharge horizontal branch pipe extending to the downstream side of a urinal according to an embodiment of the present invention.

FIG. 4 is a timing chart showing a first example of the flushing operation of a urinal according to an embodiment of the invention; FIG. 5 is a timing chart showing a second example of the flushing action in a urinal according to an embodiment of the invention; FIG. 6A-6D are a diagram showing a simplified view of the flow of flush water and urine from a urinal into a urinal discharge pipe and discharge horizontal branch pipe, in the main flush mode M0 of a urinal according to an embodiment of the invention. FIG. 7A-7C are a diagram showing a simplified view of the flow of flush water and urine from a urinal into a urinal discharge pipe and discharge horizontal branch pipe, in the first equipment flushing mode M1 of a urinal according to an embodiment of the invention. FIG. 8A-8C are a diagram showing a simplified view of the flow of flush water and urine from a urinal into a urinal discharge pipe and discharge horizontal branch pipe, in the second equipment flushing mode M2 of a urinal according to an embodiment of the invention. FIG. 9A is a diagram showing the flow of urine and flush water through the discharge horizontal branch pipe when a main flush mode M0 is executed, in a discharge horizontal branch pipe extending to the downstream side of a urinal according to an embodiment of the present invention. FIG. 9B is a diagram showing the flow of urine-mixed flush water and flush water through the discharge horizontal branch pipe when a first equipment flushing mode M1 is executed, in a discharge horizontal branch pipe extending to the downstream side of a urinal according to an embodiment of the present invention. FIG. 9C is a diagram showing the flow of flush water through the discharge horizontal branch pipe when a second equipment flushing mode M2 is executed, in a discharge horizontal branch pipe extending to the downstream side of a urinal according to an embodiment of the present invention.

In FIGS. 4 and 5, the horizontal axis shows time, and the top part of the vertical axis shows change between the OFF state, in which the body sensing sensor 52 does not sense a user, and the ON state, in which it does sense a user; the bottom part of the vertical axis shows the change between the OFF state, in which the main supply flow path electromagnetic valve 40 is closed and flush water is not spouted from the spreader 32, and the ON state, in which the main supply flow path electromagnetic valve 40 is opened, and flush water is being spouted from the spreader 32.

First we explain a first example of a urinal flushing operation according to an embodiment of the invention.

As shown in FIG. 4, in the standby state (time t0-t1), when a user stands in front of the urinal 1 (time t1) the body sensing sensor 52 normally detects the presence of a user and sends detection information to the control unit 54, and the control unit 54 recognizes the presence of the user. In a standby state prior to urination by a user, flush water is primarily present within discharge trap 20 as pooled water W.

When a user urinates into the bowl portion 16 of the urinal 1 (time t1-t2), urine flows from the bottom portion 16*a* of the bowl portion 16 into the discharge trap 20, and the majority of the originally present pooled water W is displaced (replaced) by the in-flowing urine. Immediately after urine has flowed into the discharge trap 20, the urine itself is flowing out to the urinal discharge pipe 4 and the discharge horizontal branch pipe 6 on the downstream side of the discharge trap 20. An extremely high urine concentration liquid mixture of urine and water, or essentially as-is urine, is present in the discharge trap 20 as new pooled water W. This extremely high urine concentration liquid mixture of urine and water or as-is urine present in the discharge trap 20 are discussed below as urine U.

When a user has finished urinating in the bowl portion 16 of the urinal 1 and moves away from the front of the urinal 1, the body sensing sensor 52 changes to a state whereby it no longer detects the presence of a user (time t2). After the body sensing sensor 52 continues in the detection state for a fixed time period or greater and changes to a non-detection state, the control unit 54 recognizes that the user has moved away from the urinal 1 and starts the main flush mode M0, starting a urinal flush (time t2).

In the main flush mode M0, the bowl portion 16 which has received the user's urine is flushed and the urine is discharged into the discharge trap 20.

Specifically, the control unit 54 sends a control signal to the main supply flow path electromagnetic valve 40 opening the main supply flow path electromagnetic valve 40, and a pre-determined volume of flush water Wf is spouted from the spreader 32 into the bowl portion 16. The volume of flush water spotted is set to an essentially fixed instantaneous flow volume per unit time (e.g., 9 L/min). This flush water Wf flows down the bowl portion 16 and reaches the discharge opening portion 18. This down-flowing flush water Wf is subjected to a flow path resistance when it passes through the discharge trap 20, such that it is temporarily pooled in the vicinity of the entrance to the discharge trap 20, and the head height of this temporarily pooled flush water (the head height from the normal pooled water surface) imparts pressure on the flush water discharged from the discharge trap 20, thereby changing the instantaneous flow volume of flush water. As shown in FIG. 6A-6D, the flush water Wf flows to the downstream side together with urine U as it pushes out the urine U present inside the discharge trap 20. The value of the discharge water volume or discharge instantaneous flow volume of flush water Wf and urine U discharged from the discharge trap 20 to the downstream side is determined from the volume or instantaneous flow volume of the flush water Wf spouted from the spreader 32, or the head height. For example, the value of the discharge instantaneous flow volume discharged to the downstream side from the discharge trap 20 is 7 L/min.

As shown in FIGS. 6A through 6D, the flush water Wf and urine U is discharged from the discharge trap 20 to the urinal discharge pipe 4 through the discharge apparatus connecting portion 22 and the discharge socket 24. The flush water Wf and urine U flow along the urinal discharge pipe 4 as shown by arrow B, reaching the connecting portion 56 with the discharge horizontal branch pipe 6.

Figure 6A:
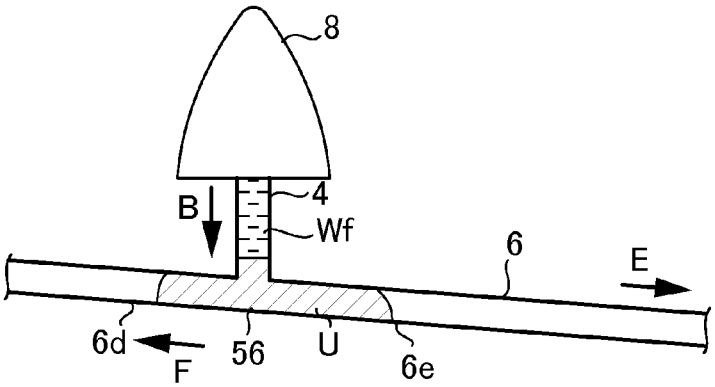
FIG. 6A is a diagram showing a simplified view of the flow of flush water and urine from a urinal into a urinal discharge pipe and discharge horizontal branch pipe, in main flush mode M0 of a urinal according to an embodiment of the invention.

As shown in FIG. 6A, flush water discharged from the discharge trap 20 to the urinal discharge pipe 4 in the main flush mode primarily flows in such a way that newly in-flowing flush water Wf pushes out urine U inside the discharge trap 20. When this flow reaches the connecting portion 56 from the urinal discharge pipe 4 it is flowing relatively fast, so that urine U is pushed out in such a way as to split into a part on the upstream side region 6*d* of the upstream side F of the discharge horizontal branch pipe 6, and a part on the downstream side region 6*e* of the downstream side E.

Figure 6B:
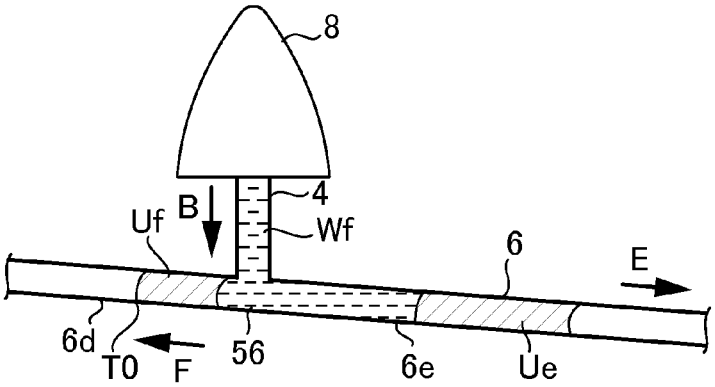
FIG. 6B is a diagram showing a simplified view of the flow of flush water and urine from a urinal into a urinal discharge pipe and discharge horizontal branch pipe, in main flush mode M0 of a urinal according to an embodiment of the invention.

As shown in FIG. 6B, when the continuing flush water Wf flows in, the urine U is split into an upstream side urine Uf and a downstream side urine Ue.

Figure 6C:
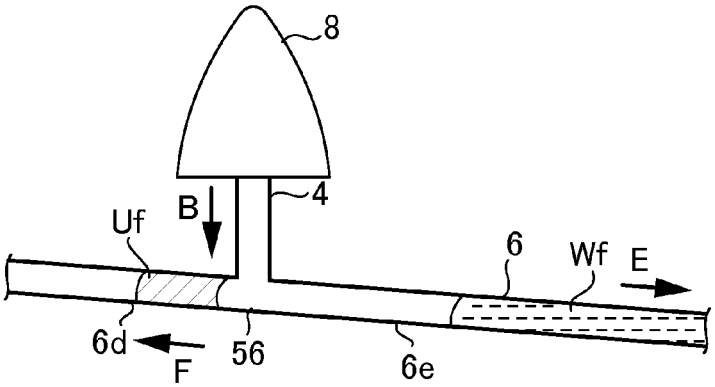
FIG. 6C is a diagram showing a simplified view of the flow of flush water and urine from a urinal into a urinal discharge pipe and discharge horizontal branch pipe, in main flush mode M0 of a urinal according to an embodiment of the invention.
Figure 6D:
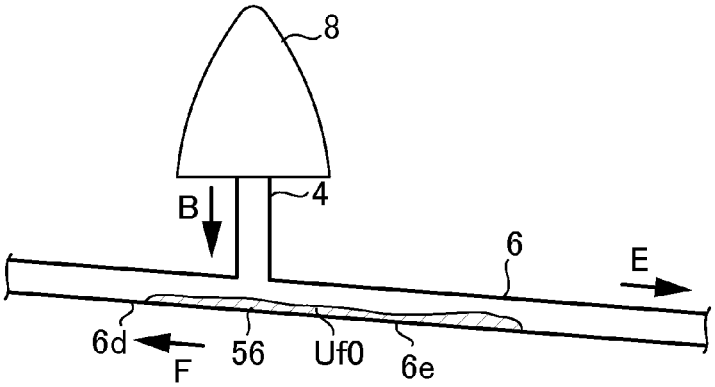
FIG. 6D is a diagram showing a simplified view of the flow of flush water and urine from a urinal into a urinal discharge pipe and discharge horizontal branch pipe, in main flush mode M0 of a urinal according to an embodiment of the invention.

Next, as shown in FIG. 6C, when supply of the flush water Wf ends (time t3), flush water Wf flows down to the downstream side along with the downstream side urine Ue. At this point, upstream side urine Uf which has reverse flowed in the direction of the upstream side F is left behind, not flowing together with the flush water Wf. As shown in FIG. 6D, after the main flush mode has ended, the upstream side urine Uf left behind in this way adheres to the inside wall of the discharge horizontal branch pipe 6 to become residual urine Uf0.

Because the main flush mode M0 flush water volume and discharge instantaneous flow volume are set at essentially a fixed level each time during discharge in the main flush mode M0, the height of the water line (water surface) WL0 at a maximum height position inside the discharge horizontal branch pipe 6 is made essentially the same each time, as shown in FIG. 9A. Therefore bacteria can easily grow on the border portion 6*b* where the inside wall surface 6*a* inside the discharge horizontal branch pipe 6 and the water surface of urine U (and/or flush water Wf) at the height WL0 position come into contact, and adhesion of uric scale 6*c* can easily occur.

In the main flush mode M0, the control unit 54 opens the main supply flow path electromagnetic valve 40 over a predetermined time (during times t2 to t3) so that, for example, 0.8 L of flush water Wf is spouted from the spreader 32. On this occasion, the flush water volume discharged from the discharge trap 20 to the downstream side in the main flush mode M0 is 0.8 L. The control unit 54 closes the main supply flow path electromagnetic valve 40 after a predetermined time has elapsed, ending the main flush mode (time t3).

Next, when a predetermined time (from time t3 to t4), for example 20 seconds, has elapsed following the end of the main flush mode M0 (time t3), the control unit 54 starts the first equipment flushing mode M1.

After the main flush mode M0 has been executed, the first equipment flushing mode M1 flushes the inside of the discharge horizontal branch pipe 6 up to the upstream side of the connecting portion 56 to which the urinal discharge pipe 4 is connected.

Specifically, the control unit 54 sends a control signal to the main supply flow path electromagnetic valve 40 opening the main supply flow path electromagnetic valve 40, and a pre-determined volume of flush water Wf is spouted from the spreader 32 into the bowl portion 16. Note that immediately before spouting starts in the first equipment flushing mode M1 mode, flush water Wf supplied in the main flush mode M0 is present inside the discharge trap 20 as pooled water W. The urine concentration in the pooled water W inside the discharge trap 20 is significantly reduced compared to the urine concentration at the time prior to starting the main flush mode M0.

In the first equipment flushing mode M1, the flush water Wf flows down the bowl portion 16 and reaches the discharge opening portion 18. This down-flowing flush water Wf is subjected to a flow path resistance when it passes through the discharge trap 20, such that it is temporarily pooled up to a head height H1 close to the discharge opening 60 of the discharge trap 20, and the head height H1 of this temporarily pooled flush water imparts pressure on the flush water discharged from the discharge trap 20. This head height can change due to supplied water volume, etc. even when the supplied instantaneous flow volume is essentially fixed. The flush water Wf flows to the downstream side together with urine U as it pushes out the urine U present inside the discharge trap 20. The value of the discharge water volume or discharge instantaneous flow volume of flush water Wf and urine U discharged from the discharge trap 20 to the downstream side is determined from the volume or instantaneous flow volume of the flush water Wf spouted from the spreader 32, or the head height.

In the first equipment flushing mode M1, the head height of flush water near the entrance to the discharge trap 20 is H1, and the corresponding discharge instantaneous flow volume of flush water discharged from the discharge trap 20 is F1. For example, the value of the discharge instantaneous flow volume F1 discharged to the downstream side from the discharge trap 20 is 7 to 8 L/min.

As shown in FIGS. 7A through 7C, flush water Wf, as shown by arrow B, flows from the discharge trap 20 along the urinal discharge pipe 4 to the rear of the urinal to reach the connecting portion 56 with the discharge horizontal branch pipe 6.

As shown in FIG. 7A, the flush water discharged from the discharge trap 20 to the urinal discharge pipe 4 in the first equipment flushing mode M1, primarily the newly in-flowing flush water Wf flows so as to push out the flush water Wf in the discharge trap 20 supplied primarily in the main flush mode M0. When this flush water Wf flow reaches the connecting portion 56 from the urinal discharge pipe 4, the flow speed is relatively fast, so the flush water Wf spreads so as to divide into an upstream side F and a downstream side E in the discharge horizontal branch pipe 6. Of the flush water Wf, the part traveling toward the upstream side F reverse flows (flows back to the upstream side) so as to cover the upstream side of the urine Uf0 in an adhered state. Therefore the flush water Wf is also able to flush adhered urine Uf0 present further to the upstream side F than the connecting portion.

As shown in FIG. 7B, the maximum reached point T1 reached by the flush water Wf at the upstream side F of the discharge horizontal branch pipe 6 in the first equipment flushing mode M1 is positioned further up the upstream side than the maximum reached point T0 reached by the urine Uf (or flush water Wf) at the upstream side F of the discharge horizontal branch pipe 6 in the main flush mode M0.

When the supply of flush water Wf ends (time t5), the flush water Wf flows down to the downstream side together with the urine Uf0. At this point, of the flush water Wf and the urine UFO which have reverse flowed toward the upstream side F, a part of the urine-mixed water Uf1 in some cases is left behind without flowing out with the flush water Wf. Therefore as shown in FIG. 7C, after the completion of the first equipment flushing mode M1 the relatively low concentration urine-mixed water Uf1 left behind in this manner adheres to the inner wall of the discharge horizontal branch pipe 6 and remains.

During discharge in the first equipment flushing mode M1, the value of the discharge volume or discharge instantaneous flow volume discharged to the downstream side from the discharge trap 20 in the first equipment flushing mode M1 is set to be equal to or larger than the value of the discharge volume or discharge instantaneous flow volume discharged to the downstream side from the discharge trap 20 in the main flush mode M0. Therefore as shown in FIG. 9B, the water line (water surface) WL1 at the maximum height position inside the discharge horizontal branch pipe 6 at time of discharge in the first equipment flushing mode M1 rises to a higher position than the water line (water surface) WL0 at the maximum height position inside the discharge horizontal branch pipe 6 at time of discharge in the main flush mode M0. Therefore in the main flush mode M0, the part on the border portion 6*b* where the uric scale 6*c* is comparatively likely to occur can be flushed with flush water capable of reaching up to the water line surface WL1 at the highest height position on the border portion 6*b* site or above, and growth of bacteria on the border portion 6*b* can be constrained, thereby constraining the adherence (occurrence) of uric scale 6*c*. Note that even if the water line WL1 in the first equipment flushing mode M1 is the same height as the water line WL0 at the border portion 6*b*, because the border portion 6*b* is flushed with relatively clean flush water, bacteria growth on the border portion 6*b* can be constrained, as can the adhesion (occurrence) of uric scale 6*c*.

The urine concentration of the flush water Wf and urine-mixed water Uf1 flowing in the discharge horizontal branch pipe 6 in the first equipment flushing mode M1 is reduced to less than the urine concentration of the urine U and flush water Wf flowing in the discharge horizontal branch pipe 6 in the main flush mode M0. Therefore in the first equipment flushing mode M1 the border portion 6*b* can be flushed with relatively clean flush water.

In the first equipment flushing mode M1, the control unit 54 opens the main supply flow path electromagnetic valve 40 over a predetermined time (between times t4-t5) thereby causing, for example, 1.0 L of flush water Wf to be spouted from the spreader 32. On this occasion, the flush water volume discharged from the discharge trap 20 to the downstream side in the first equipment flushing mode M1 is 1.0 L. The control unit 54 closes the main supply flow path electromagnetic valve 40 after a predetermined time has elapsed, ending the first equipment flushing mode M1 (time t5).

Next the control unit 54 starts the second equipment flushing mode M2 (time 6) after the elapse of a predetermined time (between time t5-t6) following the end of the first equipment flushing mode M1 (time t5). I.e., after a predetermined time has elapsed during which it is assumed that the flush water which flushed the upstream side region 6*d* on the upstream side F of the connecting portion 56 in the first equipment flushing mode M1 will have mostly flowed down to the downstream side E of the connecting portion 56, the second equipment flushing mode M2 again starts flushing the upstream side region 6*d* on the upstream of the connecting portion 56.

Specifically, the control unit 54 sends a control signal to the main supply flow path electromagnetic valve 40 opening the main supply flow path electromagnetic valve 40, and a second equipment flushing mode M2 pre-determined volume of flush water Wf is spouted from the spreader 32 into the bowl portion 16. Note that immediately before spouting starts in the second equipment flushing mode M2 mode, flush water Wf supplied in the first equipment flushing mode M1 is present inside the discharge trap 20 as pooled water W. The urine concentration in the pooled water W inside the discharge trap 20 is significantly reduced compared to the urine concentration prior to starting the first equipment flushing mode M1.

In the second equipment flushing mode M2, the flush water Wf flows down the bowl portion 16 and reaches the discharge opening portion 18. This down-flowing flush water Wf is subjected to a flow path resistance when it pass through the discharge trap 20, such that it is temporarily pooled in the vicinity of the discharge opening 60 at the entrance to the discharge trap 20, and the head height H of this temporarily pooled flush water (the head height from the normal pooled water W surface) imparts a pressure on the flush water discharged from the discharge trap 20, thereby changing the instantaneous flow volume of flush water. The flush water Wf flows to the downstream side together with flush water Wf as it pushes out the flush water Wf present inside the discharge trap 20. The value of the discharge water volume or discharge instantaneous flow volume of flush water Wf discharged from the discharge trap 20 to the downstream side is determined from the volume or instantaneous flow volume of the flush water Wf spouted from the spreader 32, or the head height.

In the second equipment flushing mode M2, the head height of flush water in the bottom portion of the bowl portion 16 is H2; the corresponding discharge instantaneous flow volume discharged from the discharge trap 20 to the downstream side is F2. For example, the value of the discharge instantaneous flow volume F2 discharged to the downstream side from the discharge trap 20 is 7 to 9 L/min.

As shown in FIGS. 8A through 8C, the flush water Wf, as shown by arrow B, flows from the discharge trap 20 along the urinal discharge pipe 4 to the rear of the urinal to reach the connecting portion 56 with discharge horizontal branch pipe 6.

As shown in FIG. 8A, the flush water discharged from the discharge trap 20 to the urinal discharge pipe 4 in the second equipment flushing mode M2, primarily the newly in-flowing flush water Wf flows so as to push out the flush water Wf in the discharge trap 20 supplied primarily in the first equipment flushing mode M1. When this flow of flush water Wf reaches the connecting portion 56 from the urinal discharge pipe 4 it is flowing relatively fast, so that flush water Wf spreads in such a way as to split into a part on the upstream side region 6*d* on upstream side F of the discharge horizontal branch pipe 6, and a part on the downstream side region 6*e* of the downstream side E. Of the flush water Wf, the part traveling toward the upstream side F reverse flows (flows back to the upstream side) so as to cover the upstream side of the urine-mixed water Uf1 in an adhered state. Therefore the flush water Wf is also able to flush adhered urine Uf1 present further on the upstream side F than the connecting portion.

In the second equipment flushing mode M2, the maximum reached point T2 reached by the flush water Wf on the upstream side F of the discharge horizontal branch pipe 6 is positioned on the upstream side of the maximum reached point T1 reached by the flush water Wf on the upstream side F of the discharge horizontal branch pipe 6 in the first equipment flushing mode M1.

As shown in FIG. 8B, when supply of the flush water Wf ends (time t7), flush water Wf flows down to the downstream side together with the urine-mixed water Uf1. At this point, the urine-mixed water Uf1 in the region on the upstream side F of the connecting portion 56 is not left in place, and it is believed that even if moisture hypothetically remained, the remaining of such moisture would be the result of flush water in which the urine component concentration had been significantly reduced due to two flushings, so adhesion of uric scale inside the discharge horizontal branch pipe 6 could be constrained.

Therefore, as shown in FIG. 8C, after completion of the second equipment flushing mode M2 flush water Wf is discharged together with urine-mixed water Uf1, and the discharge horizontal branch pipe 6 is cleanly flushed so that the residual presence of urine is constrained.

During discharge in the second equipment flushing mode M2, the value of the discharge volume or discharge instantaneous flow volume discharged to the downstream side from the discharge trap 20 in the second equipment flushing mode M2 is set to be equal or larger than the value of the discharge volume or discharge instantaneous flow volume discharged to the downstream side from the discharge trap 20 in the first equipment flushing mode M1. Therefore as shown in FIG. 9C, the water surface (water line) water line WL2 inside the discharge horizontal branch pipe 6 in the second equipment flushing mode M2 has risen to a position higher than the water surface (water line) water line WL1 inside the discharge horizontal branch pipe 6 in the first equipment flushing mode M1. Therefore in the main flush mode M0, the part on the border portion 6*b* where the uric scale 6*c* is comparatively likely to occur can be flushed with flush water capable of reaching up to the water line surface WL2 at the highest height position above the border portion 6*b*, and growth of bacteria on the border portion 6*b* can be constrained, thereby constraining the adherence (occurrence) of uric scale 6*c*. The urine concentration of the flush water Wf flowing in the discharge horizontal branch pipe 6 in the second equipment flushing mode M2 is reduced to below the urine concentration of the urine and flush water Wf flowing in the discharge horizontal branch pipe 6 in the main flush mode M0, and furthermore is reduced to below the urine concentration of the urine Uf1 and flush water Wf flowing in the discharge horizontal branch pipe 6 in the first equipment flushing mode M1. Therefore in the second equipment flushing mode M2 the border portion 6*b* can be flushed with relatively clean flush water.

In the second equipment flushing mode M2, the control unit 54 opens the main supply flow path electromagnetic valve 40 over a predetermined time (between time t6-t7) longer than the predetermined time during which the main supply flow path electromagnetic valve 40 is opened in the first equipment flushing mode M1, thereby causing, for example, approximately 1.2 L of flush water Wf to be spouted from the spreader 32. 2 L of flush water Wf are spouted from the spreader 32. At this point, the flush water volume discharged from the discharge trap 20 to the downstream side in the second equipment flushing mode M2 is 1.2 L. The control unit 54 closes the main supply flow path electromagnetic valve 40 after a predetermined time has elapsed, ending the second equipment flushing mode M2 (time t7).

Note that after the second equipment flushing mode M2 has ended, for example, the control unit 54 can open the electrolytic water flow path electromagnetic valve 46 as needed, and a electrolytic water flush mode D can be executed in which flush water into which electrolytic water (e.g., sterilizing water containing hypochlorous acid) has been injected is spouted from the spreader 32 into the bowl portion 16. By flowing electrolytic water after the interior of the discharge horizontal branch pipe 6 has been flushed, the discharge trap 20 and discharge horizontal branch pipe 6 interior can be sterilized, growth of uric scale bacteria and the like in moisture remaining in the discharge trap 20 and the discharge horizontal branch pipe 6 can be constrained, and adhesion (occurrence) of uric scale can be constrained over a long time period. The timing for injecting flush water into which electrolytic water (for example, sterilizing water containing hypochlorous acid) has been injected may be the time when the first equipment flushing mode M1 is executed, or the time when the second equipment flushing mode M2 is executed, or the time when both the first equipment flushing mode M1 and the second equipment flushing mode M2 are executed.

When the second equipment flushing mode M2 has ended, the control unit 54 continues in an equipment flushing standby mode until the elapse of a further fixed predetermined, for example until the elapse of a 2 hour predetermined time, and when this predetermined has elapsed, the control unit 54 again starts the first equipment flushing mode M1. In this manner, each time the predetermined time period has elapsed after completion of the second equipment flushing mode M2, the first equipment flushing mode M1 and second equipment flushing mode M2 are further repeated, thereby enabling suppression of the adhesion (occurrence) of uric scale inside the discharge horizontal branch pipe 6.

Next, the control unit 54, as described above, starts the first equipment flushing mode M1 (time t8). The flushing operation in this first equipment flushing mode M1 is the same as the flushing operation in the first equipment flushing mode M1 described above, so an explanation thereof is here omitted.

In the first equipment flushing mode M1, the flush water can flush the upstream side region 6*d* and the downstream side region 6*e* inside the discharge horizontal branch pipe 6, and the growth of bacteria can be constrained, as can the adhesion (occurrence) of uric scale 6*c*.

In the first equipment flushing mode M1, flush water is able to flush due to the water line WL1 reaching a maximum height position at or above the border portion 6*b* inside the discharge horizontal branch pipe 6, and bacteria growth on the border portion 6*b* is constrained, so that adhesion (occurrence) of uric scale 6*c* can be constrained.

Next, the control unit 54 furthermore starts the second equipment flushing mode M2 (time 10) after the elapse of a predetermined time (between time t9-t10) following the end of the first equipment flushing mode M1 (time t9). The flushing operation in this second equipment flushing mode M2 is the same as the flushing operation in the second equipment flushing mode M2 described above, so an explanation thereof is here omitted.

In the second equipment flushing mode M2, the flush water can more effectively flush the upstream side region 6*d* and the downstream side region 6*e* inside the discharge horizontal branch pipe 6, and the growth of bacteria can be constrained, as can the adhesion (occurrence) of uric scale 6*c*.

In the second equipment flushing mode M2, flush water is able to flush using flush water which has reached to a water line WL2 at a maximum height position at or above the border portion 6*b* in the discharge horizontal branch pipe 6, and bacteria growth on the border portion 6*b* is constrained, so that adhesion (occurrence) of uric scale 6*c* can be constrained.

If, after this second equipment flushing mode M2 has ended, the equipment flush standby state continues and a certain predetermined additionally elapses, for example if a 2 hour predetermined elapses, the control unit 54 can perform controls to again further repeat the first equipment flushing mode M1 and the second equipment flushing mode M2. Stated differently, the control unit 54 can perform a control so that after the main flush mode M0 is completed, a combination of the first equipment flushing mode M1 and the second equipment flushing mode M2 is repeatedly executed at a predetermined time interval.

Next we explain a second example of a urinal 1 flushing operation according to an embodiment of the invention.

The second example of the flushing operation of urinal 1 according to an embodiment of the invention is the same as the first example with respect to the operation in times t0-t7 and in main flush mode M0, first equipment flushing mode M1, and second equipment flushing mode M2, but differs from the first example in that after the second equipment flushing mode M2 has once been executed, prior to or during the execution of the first equipment flushing mode M1 and/or the second equipment flushing mode M2, a user can use the urinal and a main flush can again be carried out.

Note that in FIG. 5 the same reference numerals are used for the same operations as in the first example of the urinal 1 toilet flushing operation in the above-described embodiment, and an explanation thereof is omitted. The content of the main flush mode M0, first equipment flushing mode M1, and second equipment flushing mode M2 operations is also the same as in the first example, so an explanation thereof is omitted.

As shown in FIG. 5, at times t047, as in the operations shown in the above-described first example, the body sensing sensor 52 senses the use of the urinal by a user, and the control unit 54 performs the operations associated with the main flush mode M0, first equipment flushing mode M1, and second equipment flushing mode M2.

At time t7, after the second equipment flushing mode M2 has completed, the control unit 54 is in an equipment flushing standby state while a further certain predetermined time elapses, for example while an approximately two hour predetermined time elapses, and stands by until the next planned first equipment flushing mode M1.

In this equipment flushing standby state, when the body sensing sensor 52 senses the presence of a user (time t12) and the detection state by the body sensing sensor 52 continues for a usage determination time or greater, the body sensing sensor 52 changes to a non-detection state (time t13), and the control unit 54 judges that the user has urinated and used the urinal 1, so the main flush mode M0 is started to flush the urinal 1 (time t13).

When the control unit 54 judges that the urinal 1 has been used in a state in the above-described equipment flushing standby state or in other than a mid-flush state in the first equipment flushing mode M1 or second equipment flushing mode M2, these states are interrupted and ended, all subsequent planned first equipment flushing mode M1 and/or second equipment flushing mode M2, etc. are cancelled, a main flush mode M0 to flush the urinal 1 is started, and a further continuing equipment flush is performed.

If the control unit 54 detects the presence of a user in the midst of flushing in the first equipment flushing mode M1 or the second equipment flushing mode M2, it interrupts and halts said first equipment flushing mode M1 or second equipment flushing mode M2. If sensing by the body sensing sensor 52 of a user has continued for a predetermined time or greater, the control unit 54 judges that the urinal 1 has been used and cancels plans for the subsequent standby state, first equipment flushing mode M1, and/or second equipment flushing mode M2, again starting the main flush mode M0 to flush the urinal 1 and further continuing with equipment flushing. On the other hand, if sensing of a user by the body sensing sensor 52 has occurred for less than a predetermined time, the control unit 54 judges that the urinal 1 has not been used, and starts flushing the urinal by the first equipment flushing mode M1 or second equipment flushing mode M2 from the aforementioned interrupted or halted state.

If a user has thus urinated into the urinal 1 midway through the equipment protection flush operation, continuation of the equipment flush standby state and continuation of insufficient flushing of the inside of the discharge horizontal branch pipe 6 leading to adhesion (occurrence) of uric scale inside the discharge horizontal branch pipe 6 can be prevented.

Also, if a user has urinated into the urinal 1 midway through the first equipment flushing mode M1 or the second equipment flushing mode M2, continuation of the first equipment flushing mode M1 or second equipment flushing mode M2 operation, insufficient flushing of the inside of the discharge horizontal branch pipe 6 due to non-performance of the main flush mode M0, and resulting adhesion (occurrence) of uric scale inside the discharge horizontal branch pipe 6 can be prevented.

After the elapse of the planned predetermined time in the main flush mode M0, the control unit 54 closes the main supply flow path electromagnetic valve 40 and ends the main flush mode M0 (time t14). Subsequently, as in the above-described first example, after the elapse of a predetermined time, for example 20 seconds (between time t14-t15), following the completion of the main flush mode M0 (time t14), the control unit 54 starts the first equipment flushing mode M1 (time t15). The control unit 54 closes the main supply flow path electromagnetic valve 40 after a predetermined time has elapsed, ending the first equipment flushing mode M1 (time t16). Also, the control unit 54 starts the second equipment flushing mode M2 after the elapse of a predetermined time (between time t16-t17) following the end of the first equipment flushing mode M1 (time t16).

After the control unit 54 closes the main supply flow path electromagnetic valve 40 following the elapse of a predetermined time, and the second equipment flushing mode M2 (time t18) is ended, up until a further predetermined time elapses, for example up until an approximately two hour predetermined time elapses, the equipment flush standby state is continued. In this manner, the series of urinal 1 equipment protection flushing operations is as a rule continued repeatedly, and the adhesion (occurrence) of uric scale inside the discharge horizontal branch pipe 6 can be constrained.

Next we explain the operational effect of a urinal 1 according to an embodiment of the invention.

Using a urinal 1 according to the above-described embodiment of the invention, in the main flush mode M0 for discharging urine in the discharge trap 20, even when urine in the discharge horizontal branch pipe 6 reverse-flows up to the upstream side of the connecting portion 56 to which the urinal discharge pipe 4 is connected and remains, after the main flush mode M0 has been executed it is possible to carry out two flushings, by using the first equipment flushing mode M1, whereby a part of the flush water flushes the inside of the discharge horizontal branch pipe 6 on the upstream side of the connecting portion 56 to which the urinal discharge pipe 4 is connected, and by using the second equipment flushing mode M2, whereby, after execution of the first equipment flushing mode M1, and after a predetermined time during which it is assumed that flush water which has flushed the upstream side of the connecting portion 56 in the first equipment flushing mode M1 will have flowed down the downstream side of the connecting portion 56, a part of the flush water flushes the upstream of the connecting portion 56. In either one of the first equipment flushing mode M1 or the second equipment flushing mode M2, the value of the discharge water volume or instantaneous flow volume discharged to the downstream side from the discharge trap portion 20 is a value equal to or greater than the value of the discharge water volume or instantaneous flow volume discharged from the discharge trap portion 20 in the main flush mode M0.

Therefore urine which has reverse-flowed in the discharge horizontal branch pipe 6 up to the upstream side of the connecting portion 56 to which the urinal discharge pipe 4 is connected and remains after execution of the main flush mode M0 can be discharged from the discharge horizontal branch pipe 6, and the occurrence of uric scale in the discharge horizontal branch pipe 6 on the upstream side of the connecting portion 56 can be constrained.

Also, in either one of the first equipment flushing mode M1 or the second equipment flushing mode M2, the value of the discharge water volume or instantaneous flow volume discharged to the downstream side from the discharge trap portion 20 is a value equal to or greater than the value of the discharge water volume or instantaneous flow volume discharged from the discharge trap portion 20 in the main flush mode M0. Therefore the height of the flush water line inside the discharge horizontal branch pipe 6 in at least one of either the first equipment flushing mode M1 or the second equipment flushing mode M2 can be made higher than the height of the flush water line inside the discharge horizontal branch pipe 6 in the main flush mode M0. The vicinity of the flush water line inside the discharge horizontal branch pipe 6 can be flushed with relatively low urine concentration flush water in the main flush mode M0, effectively flushing the vicinity of the flush water line where uric scale is prone to adhere, thereby constraining the occurrence of uric scale.

Therefore even if the flush water volume has been reduced by water conservation, the occurrence of uric scale in a discharge horizontal branch pipe 6 can be constrained.

In the urinal 1 according to an embodiment of the invention, in the first equipment flushing mode M1 and second equipment flushing mode M2 the value of the discharge volume or discharge instantaneous flow volume discharged to the downstream side from the discharge trap 20 is equal to or greater than the value of the discharge volume or discharge instantaneous flow volume in the main flush mode M0.

The height of the flush water line inside the discharge horizontal branch pipe 6 in the first equipment flushing mode M1 may be made equal to or greater than the height of the flush water line inside the discharge horizontal branch pipe 6 in the main flush mode M0; in addition, the height of the flush water line inside the discharge horizontal branch pipe 6 in the second equipment flushing mode M2 may be made equal to or greater than the height of the flush water line inside the discharge horizontal branch pipe 6 in the first equipment flushing mode M1. Therefore the vicinity of the flush water line inside the discharge horizontal branch pipe 6 in the main flush mode M0 can be flushed with flush water in the first equipment flushing mode M1, which has a relatively lower urine concentration than flush water in the main flush mode M0 and, in addition, flushing can be performed with flush water in the second equipment flushing mode M2, which has a relatively lower urine concentration than flush water in the first equipment flushing mode M1, so the occurrence of uric scale can be constrained by effectively flushing in the vicinity of the water line, where uric scale easily adheres.

Also, urine which has reverse-flowed in the horizontal branch pipe 6 to the upstream side of the connecting portion 56 and remains after execution of the main flush mode M0 can be flushed with the first equipment flushing mode M1 flush water, which reaches further upstream than that urine; it can further be flushed with second equipment flushing mode M2 flush water, which reaches further upstream than the first equipment flushing mode M1 flush water, effectively discharging the urine from the discharge horizontal branch pipe 6, so the occurrence of uric scale in the discharge horizontal branch pipe 6 on the upstream side of the connecting portion 56 can be constrained.

Therefore even if flush water volume has been reduced by water conservation, the occurrence of uric scale in a discharge horizontal branch pipe 6 can be constrained.

Using a urinal 1 according to an embodiment of the invention, the value of the discharge instantaneous flow volume discharged to the downstream side from the discharge trap 20 gradually is increased.

Therefore the height of the flush water line inside the discharge horizontal branch pipe 6 in the first equipment flushing mode M1 may be made equal to or greater than the height of the flush water line inside the discharge horizontal branch pipe 6 in the main flush mode M0; in addition, the height of the flush water line inside the discharge horizontal branch pipe 6 in the second equipment flushing mode M2 may be made equal to or greater than the height of the flush water line inside the discharge horizontal branch pipe 6 in the first equipment flushing mode M1. Hence the vicinity of the flush water line inside the discharge horizontal branch pipe 6 in the main flush mode M0 can be flushed with flush water in the first equipment flushing mode M1, which has a relatively lower urine concentration than flush water in the main flush mode M0 and, in addition, flushing can be performed with flush water in the second equipment flushing mode M2, which has a relatively lower urine concentration than flush water in the first equipment flushing mode M1, so the occurrence of uric scale can be constrained by effectively flushing in the vicinity of the water line, where uric scale easily adheres.

Also, urine which has reverse-flowed in the horizontal branch pipe 6 to the upstream side of the connecting portion 56 and remains after execution of the main flush mode M0 can be flushed with the first equipment flushing mode M1 flush water, which reaches further upstream than that urine; it can further be flushed with second equipment flushing mode M2 flush water, which reaches further upstream than the first equipment flushing mode M1 flush water, effectively discharging the urine from the discharge horizontal branch pipe 6, so the occurrence of uric scale in the discharge horizontal branch pipe 6 on the upstream side of the connecting portion 56 to which the urinal discharge pipe 4 is connected can be constrained.

Therefore even if flush water volume has been reduced by water conservation, the occurrence of uric scale in a discharge horizontal branch pipe 6 can be constrained.

Using the urinal 1 according to an embodiment of the invention, when the supplied instantaneous flow volume to the bowl portion 16 from the spreader 32 in any of the main flush mode M0, first equipment flushing mode M1, or second equipment flushing mode M2 is essentially the same, the head height of flush water which has been subjected to flow path resistance from the discharge trap 20 and temporarily pools close to the entrance opening of the discharge trap 20 can be varied in each of the main flush mode M0, first equipment flushing mode M1, and second equipment flushing mode M2. Therefore the value of the discharge instantaneous flow volume can be determined in a relatively simple way for each of the main flush mode M0, first equipment flushing mode M1, and second equipment flushing mode M2 in accordance with the height of the flush water head temporarily pooled near the entrance to the discharge trap portion 20, without requiring a special configuration to change the instantaneous supply flow volume from the spreader 32 to the bowl portion 16.

Using the urinal 1 according to an embodiment of the invention, after the main flush mode M0 is executed the first equipment flushing mode M1 and the second equipment flushing mode M2 executed after execution of the first equipment flushing mode M1 are respectively repeatedly executed at a predetermined interval. Therefore equipment flushing is continuously executed, and urine on the inside of the discharge horizontal branch pipe 6 which has reverse-flowed to the upstream side of the connecting portion 56 and remains can be discharged from the discharge horizontal branch pipe, and the occurrence of uric scale in the discharge horizontal branch pipe 6 on the upstream side of the connecting portion to which the urinal discharge pipe 4 is connected can be constrained.

Also, equipment flushing is continuously executed, and the vicinity of the flush water line inside the discharge horizontal branch pipe 6 can be flushed with relatively low urine concentration flush water in the main flush mode M0, effectively flushing the vicinity of the flush water line where uric scale is prone to adhere, thereby constraining the occurrence of uric scale.

Using a urinal 1 according to an embodiment of the invention, if the body sensing sensor 52 senses a user after execution of the main flush mode M0 and in the midst of execution of first equipment flushing mode M1 or second equipment flushing mode M2, the control unit 54 stops the first equipment flushing mode M1 or the second equipment flushing mode M2, and if sensing by the body sensing sensor 52 of a user equals or exceeds a predetermined time, a judgment is made that the user has used the urinal 1; execution of subsequent first equipment flushing mode M1 or second equipment flushing mode M2 is cancelled, the main flush mode M0 is executed and, after execution of the main flush mode M0, the first equipment flushing mode M1 and the second equipment flushing mode M2 which follows execution of the first equipment flushing mode M1 can be repeatedly executed at a predetermined time interval.

Using a urinal 1 according to an embodiment of the invention, if the body sensing sensor 52 senses a user after execution of the main flush mode M0 and in the midst of execution of first equipment flushing mode M1 or second equipment flushing mode M2, the control unit 54 stops the first equipment flushing mode M1 or the second equipment flushing mode M2, and if sensing by the body sensing sensor 52 of a user is for less than a predetermined time, a judgment is made that the urinal 1 has not been used; execution of subsequent first equipment flushing mode M1 or second equipment flushing mode M2 is not cancelled, execution of the first equipment flushing mode M1 or the second equipment flushing mode M2 is restarted from the stopped mode, and the first equipment flushing mode M1 and the second equipment flushing mode M2 which follows execution of the first equipment flushing mode M1 can be repeatedly executed at a predetermined time interval.

Using the urinal 1 according to an embodiment of the invention, in a state whereby the second equipment flushing mode M2 has been executed, and it is assumed that urine has been largely removed from the discharge trap 20 and from the inside of the discharge horizontal branch pipe 6, execution by the control unit 54 of the electrolytic water flushing mode to flow electrolytic water through the discharge trap 20 and the discharge horizontal branch pipe 6 enables the growth of bacteria inside the discharge trap 20 and the discharge horizontal branch pipe 6 to be constrained, so that the occurrence of uric scale can be constrained.

Using the urinal 1 according to an embodiment of the invention, in a state whereby the first equipment flushing mode M1, the second equipment flushing mode M2, or the first equipment flushing mode M1 and the second equipment flushing mode M2 have been executed, and whereby it is assumed that urine has been largely removed from the discharge trap 20 and from the inside of the discharge horizontal branch pipe 6, execution by the control unit 54 of the electrolytic water flushing mode to flow electrolytic water through the discharge trap 20 and the discharge horizontal branch pipe 6 enables the growth of bacteria inside the discharge trap 20 and the discharge horizontal branch pipe 6 to be constrained, so that the occurrence of uric scale can be constrained.

What is claimed is:

1. A urinal connected to a horizontal branch pipe by a urinal discharge pipe, comprising:

a bowl portion for receiving a user's urine;

a discharge trap portion for discharging to the downstream side flush water or urine flowing in from a discharge opening formed on the bottom portion of this bowl portion;

a water supply means for supplying flush water to the bowl portion;

and a control means for controlling the supply of flush water to the bowl portion;

wherein the control means has:

a main flush mode for flushing the bowl portion which has received the user's urine and discharging urine in the discharge trap;

a first equipment flushing mode in which, after a main flush mode is executed, a part of the flush water flushes out the discharge horizontal branch pipe upstream of the connecting portion where the urinal discharge pipe is connected;

a second equipment flush mode in which, after the first equipment flushing mode has been executed, and after a predetermined time has elapsed during which it is assumed that flush water which has flushed the side upstream of the connecting portion in the first equipment flushing mode will have flowed to downstream of the connecting portion, a part of the flush water flushes the upstream side of the connecting portion;

wherein in at least one of either the first equipment flushing mode or the second equipment flush mode, the value of the discharge water volume or of the discharge instantaneous flow volume discharged to the downstream side from the discharge trap portion shall be a value equal to or greater than the value of the discharge water volume or of the discharge instantaneous flow volume discharged to the downstream side from the discharge trap portion in the main flush mode.

2. The urinal of claim 1, wherein the value of the discharge water volume or of the discharge instantaneous flow volume in the first equipment flushing mode shall be a value equal to or greater than the value of the discharge water volume or the discharge instantaneous flow volume in the main flush mode and, moreover, the value of the discharge water volume or of the discharge instantaneous flow volume in the second equipment flushing mode shall be a value equal to or greater than the value of the discharge water volume or the discharge instantaneous flow volume in first equipment flushing mode.

3. The urinal of claim 2, wherein the value of the instantaneous flow volume in the first equipment flushing mode shall be a value equal to or greater than the discharge instantaneous flow volume in the main flush mode and, moreover, the value of the instantaneous flow volume in the second equipment flushing mode shall be a value equal to or greater than the discharge instantaneous flow volume in the first equipment flushing mode.

4. The urinal of claim 3, wherein in each of the main flush mode, the first equipment flushing mode, and the second equipment flush mode, the instantaneous supply flow volume to the bowl portion from the water supply means shall be approximately the same, and in each of the main flush mode, the first equipment flushing mode, and the second equipment flush mode the value of the instantaneous flow volume is determined in response to the head height of flush water temporarily pooled near the entrance to the discharge trap portion.

5. The urinal of claim 1, wherein the control means, after execution of the main flush mode, repeatedly executes, at a predetermined time interval, the first equipment flushing mode and the second equipment flush mode executed after execution of the first equipment flushing mode.

6. The urinal of claim 5, further having a sensing means for sensing a user using the urinal, wherein when the first equipment flushing mode or the second equipment flush mode is executed, if the sensing means senses the presence of a user, the control means stops the first equipment flushing mode or the second equipment flush mode, and if a user is sensed by the sensing means for a predetermined time or greater, the control means judges that the urinal has been used, and cancels execution of a subsequent first equipment protection flushing mode and second equipment protection flush mode, executing a main flush mode after the sensing means ceases to sense a user.

7. The urinal of claim 6 in which, furthermore, when executing the first equipment flushing mode or the second equipment flushing mode, if the sensing means has sensed a user, the control means stops the first equipment flushing mode or the second equipment flushing mode, and when a user is sensed by the sensing means for less than a predetermined time, the control means judges that the urinal is not being used, and subsequently resumes execution of the first equipment protection flushing mode or the second equipment protection flush mode.

8. The urinal of claim 1, further comprising an electrolytic water flushing mode wherein, after the second flushing mode is executed, flush water into which electrolytic water has been injected is flowed into the discharge trap portion and the discharge horizontal branch pipe.

9. The urinal of claim 1 further comprising an additional electrolytic water flushing mode for flowing flush water injected with electrolytic water into the discharge trap portion and the discharge horizontal branch pipe when the first flushing mode, the second flushing mode, or the first flushing mode and the second flushing mode are executed.

* * * * *